United States Patent [19]

Dayus

[11] 4,103,601

[45] Aug. 1, 1978

[54] AIR GRILLE COMPONENTS AND AIR GRILLE THEREFROM

[76] Inventor: Lloyd Giddis Dayus, 3400 Riverspray Dr., Mississauga, Canada

[21] Appl. No.: 734,956

[22] Filed: Oct. 22, 1976

[51] Int. Cl.[2] ..... F24F 13/00

[52] U.S. Cl. ..... 98/110; 49/74; 98/114; 98/121 A; 137/601

[58] Field of Search ..... 98/110, 114, 121 R, 98/121 A, 40 VM; 137/601; 49/74–80

[56] References Cited

U.S. PATENT DOCUMENTS

| | | | |
|---|---|---|---|
| 2,557,502 | 6/1951 | Goettl | 98/121 R |
| 2,972,358 | 2/1961 | Hinde | 98/121 R |
| 2,998,765 | 9/1961 | Spargo | 98/110 |
| 3,084,715 | 4/1963 | Scharres | 137/601 |
| 3,125,944 | 3/1964 | Radcliff | 98/40 VM |
| 3,361,049 | 1/1968 | Sweeney | 98/121 R |
| 3,372,514 | 3/1968 | Adams | 98/121 R |
| 3,500,739 | 3/1970 | Dry | 98/121 R |
| 3,604,458 | 9/1971 | Silvey | 137/601 |
| 3,653,317 | 4/1972 | Costanzo, Jr. | 98/121 R |
| 3,786,738 | 1/1974 | Fahre | 98/114 |
| 3,800,688 | 4/1974 | Parrish | 98/114 |
| 3,968,738 | 7/1976 | Matzke | 98/121 R |

*Primary Examiner*—Ronald C. Capossela

[57] ABSTRACT

A group of novel components for use in a composite air grille including an air director blade assembly having parallel blades and blade supporting bars at each end, and including a novel form of blade therefor, and including novel frame components, and an air grille using such components.

20 Claims, 23 Drawing Figures

AIR GRILLE COMPONENTS AND AIR GRILLE THEREFROM

The present invention relates the components of an air grille of a type which may be constructed in a variety of different dimensions without excessive tooling costs, and to a grille using these components.

BACKGROUND OF THE INVENTION

Typical air grilles incorporate a rectangular metal framework, and a plurality of transverse blades. Usually the blades are rotatable, and are secured by friction, when adjusted, in any particular position. Sometimes two sets of blades are required one behind the other, arranged at right angles to each other.

Manufacturers generally speaking establish a range of sizes or dimensions for such grilles, and are therefore forced to use a variety of components for the frames, and a variety of blades, of differing lengths, to provide different sizes of grilles. Tooling costs and parts inventory can therefore be quite a considerable burden.

However, commercial and industrial requirements for air grilles depend upon architects or engineers specifications, and it is generally speaking not acceptable simply to provide such air grilles in a range of standard sizes. Ideally, the manufacturer should be able to provide air grilles in accordance with any dimensional specifications which the architect requires to suit the particular design of the building under construction. However, such flexibility in dimensions, in accordance with known manufacturing practise, requires either an excessive amount of tooling to produce various sizes of air grilles, or alternatively, involves excessive hand labour and certain manual skills which increase the cost of the air grille significantly.

It is therefore desirable to provide an air grille construction in which the measurements may be entirely flexible and may be varied within wide limits without the use of separate tooling for different sizes, and with a minimum of hand labour such that the cutting, bending and fitting of the various parts as required takes place automatically in accordance with dimensional specifications which have been preprogrammed.

BRIEF SUMMARY OF THE INVENTION

The invention therefore seeks to provide an air director blade assembly for an air grille the assembly having a plurality of air director blades arranged parallel with one another, and there being a pair of blade supporting bars supporting and locating the opposite ends of said blades. The blade supporting bars are adapted to be mounted on opposite sides of a frame, whereby the assembly consisting of blades and blade supporting bars may be assembled independently of the frame, and then placed in position in the frame, to complete the grille.

More particularly, it is an objective of the invention to provide an air director blade assembly having the foregoing advantages in which the blade support bars are provided with bearing holes for receiving the tongue means of the blade members, and recesses formed around the bearing holes for receiving portions of said tongue means therein and providing frictional engagement between said tongue means and said blade support bars whereby said blades may be rotated and preset and secured by means of such frictional engagement in a preset position.

More particularly, it is an objective of the invention to provide a frame for an air grille using the foregoing director assembly in which the side members of the frame incorporate offset channels for receiving said blade support bars, whereby to conceal and support said blade support bars, and to provide a maximum open area for the flow of air through said grille.

More particularly, it is an objective of the invention to provide an air director blade assembly having the foregoing advantages wherein the blade members comprise two layers of sheet metal, folded over or closed at the edges of the blades, and forming a more or less flattened ellipitical airfoil shape in section, formed by an outwardly distended portion of each said layer, and wherein said tongue means at each end of said blade comprises endwise extensions from each said layer.

More particularly, it is an objective of the invention to provide an air grille frame having the foregoing advantages in which the side members of the frame incorporate a pair of recessed channels arranged in spaced apart parallel relation, whereby each said channel may receive a said blade support bar therein, for the manufacture of a grille having two sets of blade members.

It is a further objective of the invention to provide a novel corner locking member for joining the corners of the frame.

It is a related objective to provide a composite air grille consisting of a frame, and director blade assembly according to the invention.

The invention also provides a novel form of blade for use in the above components, and a novel form of frame component stock for manufacture of the above frames.

The foregoing and other objectives of the invention will become apparent from the following description of a preferred embodiment of the invention which is given here by way of example only with reference to the following drawings.

DESCRIPTION OF A SPECIFIC EMBODIMENT

Figure 1:
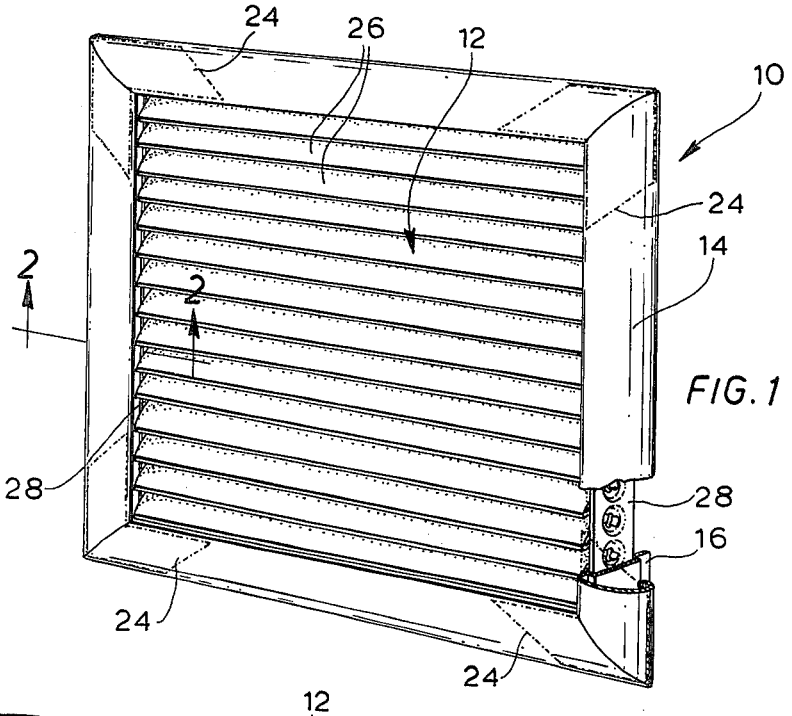
FIG. 1 is a front perspective illustration of an air grille according to the invention.
Figure 2:
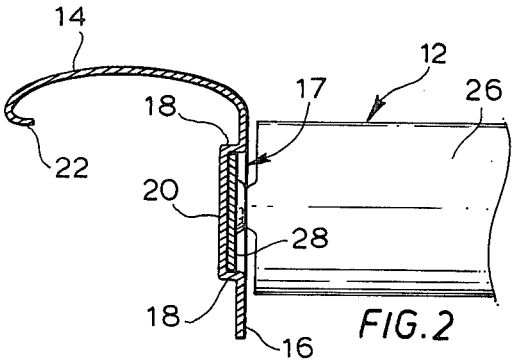
FIG. 2 is a section along the line 2—2 of FIG. 1.
Figure 8:
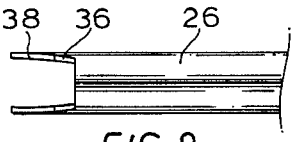
FIG. 8 is a plan view of the blade of FIG. 7, along the line 8—8.
Figure 9:
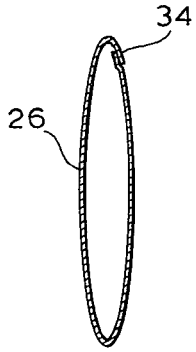
FIG. 9 is a sectional view of the blade along the line 9—9 of FIG. 7.

Referring now to FIGS. 1, 2 and 8, it will be seen that the air grille using components according to the invention comprises a rectangular framework indicated generally as 10, and an air director blade assembly indicated generally as 12. The frame 10 is formed typically of roll formed, die formed, or extruded material of uniform cross-section along its length, joined at the corners, such cross-section providing a facing flange 14, and a side wall 16. The side wall 16 is formed with a recessed channel 17 extending longitudinally along its inwardly directed face, the channel having side walls 18 and an intermediate web 20.

The free edge of the facing flange 14 is turned in as at 22 to provide a smooth finish. Such an inturned portion 22 provides a convenient means of joining the corners, by means of L-shaped angle plates 24 (shown in phantom), and joining means may be used such as a weld, a rivet, or staking. Plates 24 in accordance with this invention, have novel locking means (see FIG. 23), however, which avoids the use of such a fastening requirement.

Figure 16:
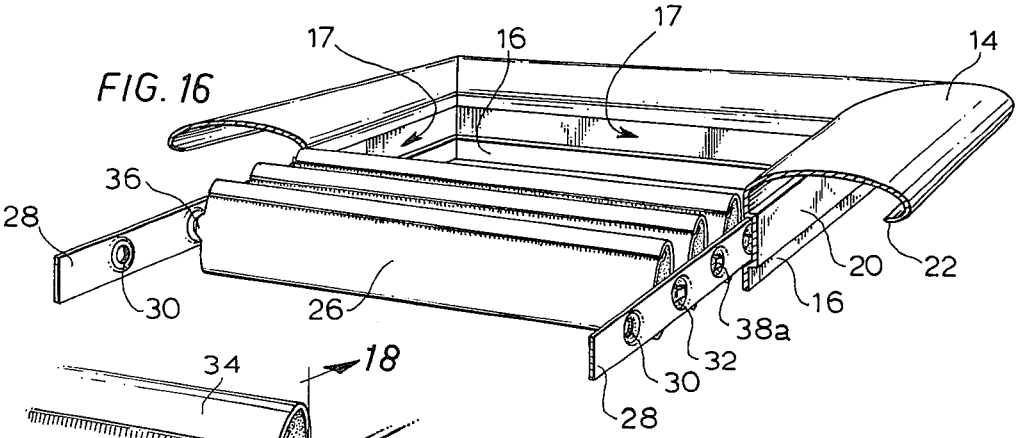
FIG. 16 is a perspective illustration of the air grille of FIG. 1, with the frame cut away to reveal the construction thereof.
Figure 17:
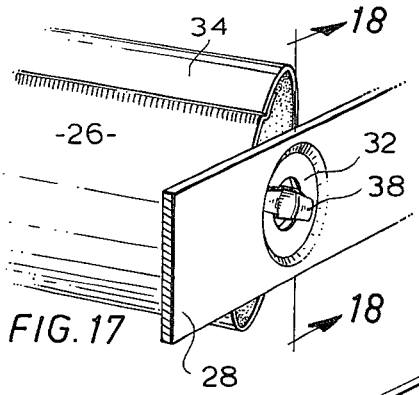
FIG. 17 is a perspective illustration of a blade shown at a stage in the manufacture and assembly of the air grille.

The blade assembly 12, as best shown in FIGS. 16 and 17, comprises a plurality of air director blade members 26, rotatably mounted at each end in mounting bars 28. The mounting bars 28 are elongated flat sheet metal members with holes 30 stamped therethrough at regularly spaced intervals. Around the holes 30 are formed depressions 32 for purposes to be described.

According to one form of the invention, the blade members 26 are of double walled hollow sheet metal construction, provided with a generally elliptical airfoil shape along their length. Preferably, such blade members will be formed by roll forming the sheet metal and seaming along one edge as at 34. Alternatively, the blade members of this type could be made of two separate pieces of sheet metal formed with seams 34 along each edge, if desired.

At each end of the blade members 26, bearing shoulders 36 are formed, and extending from such bearing shoulders 36 are the riveting extensions 38. It will of course be appreciated that since the blade member 26 is of double wall construction, there are two such shoulder members 36, one extending from each wall, and there are two such riveting extensions 38, one extending from each wall, such shoulders and riveting extensions being spaced apart by a spacing equal to the spacing between the two walls of the blade member 26 as shown.

Figure 18:
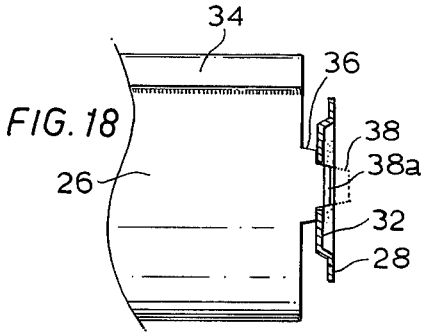
FIG. 18 is a sectional illustration along the line 18—18 of FIG. 17.

As shown in FIGS. 17 and 18, the riveting extensions 38 of the blade members 26 extend through the holes 30 in the support bars 28, and are then riveted or stamped over as at 38*a* so as to retain the blade members 26 in position. Preferably, such stamping or riveting action is sufficient to provide a relatively tight fit against the support bars 28, and provide for a certain degree of frictional resistance to rotation of the blades 26, so that once they are preset into a desired air direction pattern, they will retain that position until they are reset into a new pattern. As is shown in FIG. 18, the stamped or riveted extensions 38*a* lie within the depressions 32 around the holes 30.

The support bars 28, carrying the blades 26 are received in the channels comprising the side walls 18 and web 20 in the wall 16 of the frame 10, and constitute the blade assembly 12 as shown in FIG. 1 in the finished grille.

Figure 4:
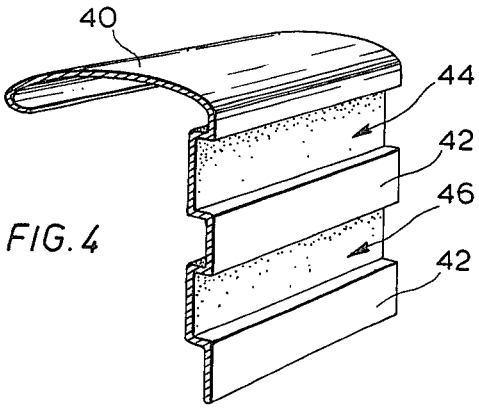
FIG. 4 is a perspective illustration corresponding to FIG. 3 showing an alternate embodiment.

Various modifications can be made to the invention. For example, as shown in FIG. 4, it may be desirable to provide a grille having two sets of blade assemblies 12. Accordingly, a modified form of framework will be provided having a facing flange 40, and side wall 42, and two channels indicated generally as 44 and 46 respectively. Clearly, two blade assemblies 12 can then be inserted into such channels 44 and 46 respectively. Preferably, one such blade assembly 12 will be rotated 90° with respect to the other so as to render the grille substantially sight proof.

Figure 11:
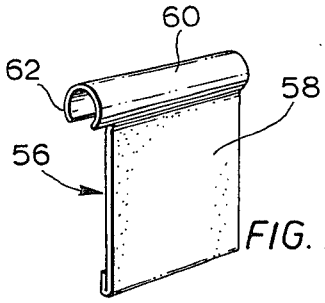
FIGS. 10, 11 and 12 show alternate forms of blade.
Figure 12:
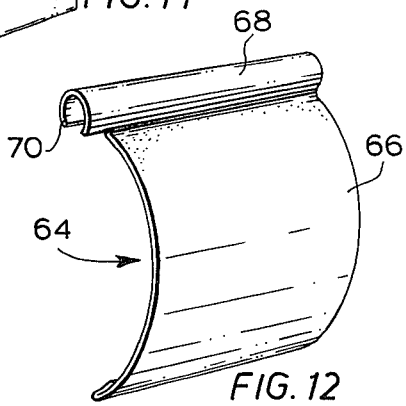
Figure 10:
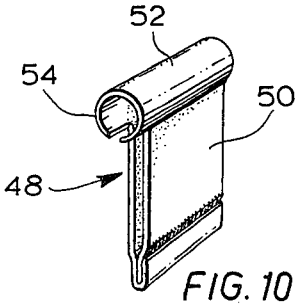

Other forms of blade member may be employed in certain circumstances. For example, as shown in FIGS. 10, 11 and 12 blades may be employed which are pivoted along one side edge instead of pivoting along a centre line as in the case of the blade 26. If, for example, a blade 48 as shown in FIG. 10 may comprise a double thickness director portion 50, formed of sheet metal folded over on itself, and having along one edge a generally cylindrical formation 52. At each end of the blade 48 the cylindrical portion 52 may extend outwardly as at 54 to provide a riveting extension, adapted to extend through the holes 30 in the bars 28.

A somewhat lighter form of blade could be made in much the same way as shown by the blade 56 of FIG. 11. In this case, the air director portion 58 comprises a single thickness of metal with only its free edge turned over to avoid roughness. A similar cylindrical formation 60 is formed along the other edge, having an extension 62 for riveting in the manner described above.

As shown in FIG. 12, a further form of blade 64 may be provided similar to the blade 56 of FIG. 11, but having a curved director portion 66 turned over at its free edge, and having a cylindrical formation 68 on the other edge thereof and an extension 70 for riveting and the like.

Figure 13:
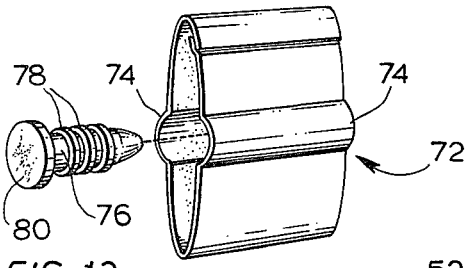
FIG. 13 shows a further alternate form of blade, and blade mounting means.

Other forms of pivotal mounting for the blades may be provided, other than the riveting extensions as described above. For example, as shown in FIG. 13 a blade 72 may be provided, of similar construction for example to the blade 26 of FIG. 5. In this case however, a longitudinal curved groove formation 74 may be formed down either side thereof, and the riveting extensions are eliminated. In their place a pivot pin 76 may be provided having frictional formations 78 along its length. The pin 76 would then be inserted through the openings 30 in the support bars 28 and driven into the blades 72, along the line of the channel formations 74.

Preferably, the heads 80 of the pins 76 will provide frictional engagement within the depressions 32 around the holes 30.

Figure 14:
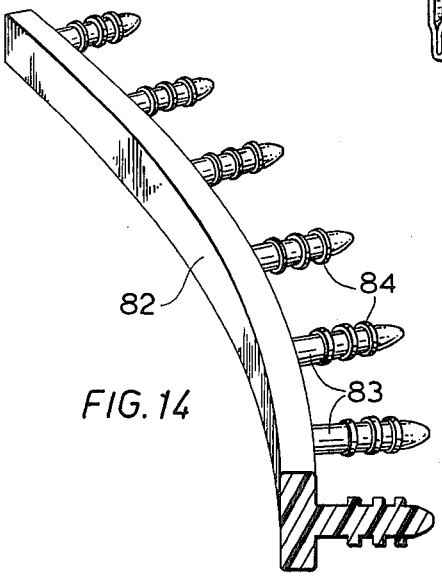
FIG. 14 shows a further alternate form of blade mounting means.

A further alternative form of blade retention is shown in FIG. 14. In this case, a flexible plastic strip 82 is provided with a series of retaining pins 83 extending therefrom having frictional formations 84 thereon. The pins 83 are arranged spaced apart a distance equal to the spacing between the holes 30 in the support bars 28. Such plastic strips 82 may be for example injection molded with 12 or more such pins 83 on each such strip. These would be used in conjunction with a blade similar to blade 72. In this case, however, the rotation of the blades would be achieved by rotating them relative to the pins 83, the pins 83 providing frictional retention of the blades in any desired position.

Alternatively, a continuous metal support bar 85 can be provided with plastic pins 86 fastened thereto at spaced intervals, and having frictional formations 87 thereon, performing the same function as the strip 82 and pins 83 of FIG. 14.

By use of the invention, it will, therefore, be seen that it is possible to prepare uniform cross-section frame material, and uniform cross-section blades and uniform cross-section blade support bars, in any desired lengths. Such lengths may then be cut off in a simple punch press or shear to any desired length, and assembled readily with a minimum of hand operations, Thus, one relatively inexpensive set of tooling will permit a manufacturer to produce registers of any dimensions at all. Similarly, it is not necessary for the manufacturer to warehouse substantial inventories of different sizes of parts. All that is required is to maintain on hand a sufficient quantity of lengths of the stock from which the parts will be made, to handle any order that may come in at any time.

Furthermore, if the various lengths of stock are made by roll forming then it is possible that no inventory of lengths of stock need be maintained at all. Rolls of sheet metal is all that will be required to be maintained in inventory, and the parts will be formed in the lengths desired as orders are received.

Figure 5:
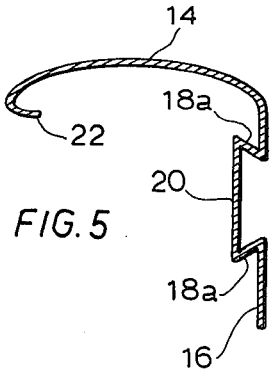
FIG. 5 shows an alternate form of frame stock for use in the invention.
Figure 6:
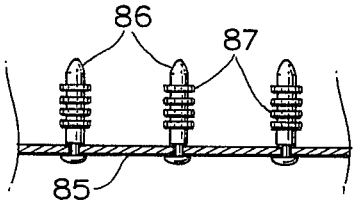
FIG. 6 shows an alternate form of blade supporting bar.
Figure 7:
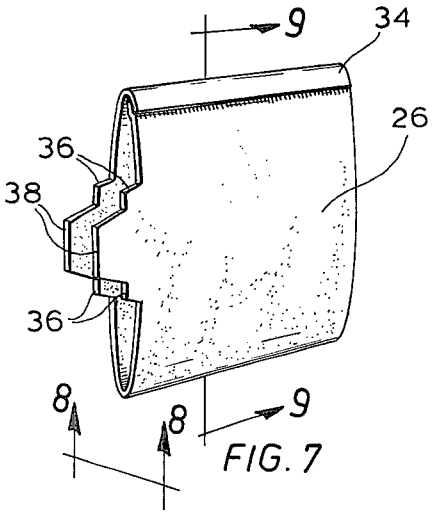
FIG. 7 is a perspective illustration of a blade, showing the formation of the end member of the blade prior to assembly.

Further modifications may be made to the frame. For example, the side walls 18*a* of the channel can be arranged in an angled manner instead of providing a simple channel (FIG. 5). In this way, the blade support bars 28 could be made so as to slide within such a channel and be retained therein by the inward convergence of the side walls 18*a*. Furthermore, it will, of course, be appreciated that while the frame 10 as shown in FIG. 1 is made of uniform stock on all four sides, if desired, two different types of frame stock can be made up, one with the channel, and one with a straight side wall 16. In this way, if desired, a frame could be made up in which only two opposite sides were formed with channels and the other two opposite sides were formed without. However, in most cases this would not be necessary, and it would, of course, involve the use of additional tooling and the production of further parts.

Figure 15:
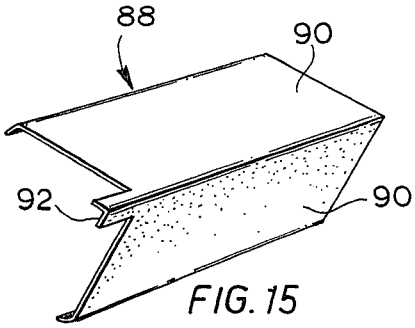
FIG. 15 shows a form of fixed blade for sightproof grilles.

Other forms of air grille can be made in the same way, without providing for pivoting blades. For example, a sight proof blade 88 may be used consisting of two air director portions 90, meeting at an angle (see FIG. 15) and having riveting extensions 92. Such blades can be installed in mounting bars 28 in any one of the various ways described above, the fastening being somewhat more secure so that no rotation can take place at all.

Various modifications can be made to the support bars 28.

Figure 21:
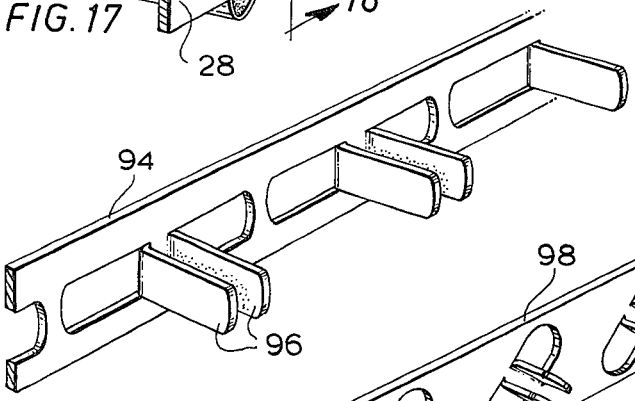
FIG. 21 is a perspective illustration showing an alternate form of support bar and means for fastening the blades.
Figure 22:
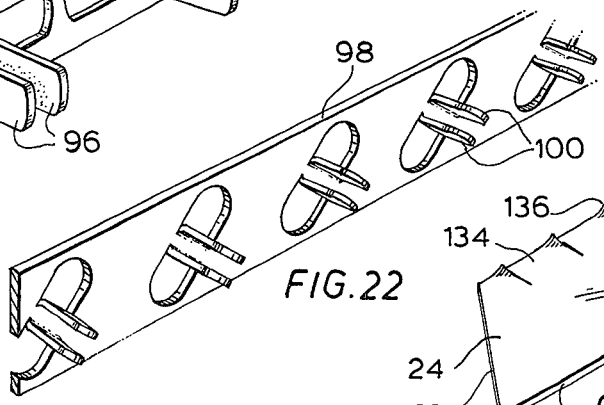
FIG. 22 shows a further alternate form of support bar for mounting the blades, and, FIG. 23 shows a corner detail.

For example, as shown in FIGS. 21 and 22, a modified form of support bar 94 may be provided, having a series of pairs of struck-out tongues 96. Such tongues 96 would be inserted into cylindrical formations on the blade, such as those shown in FIGS. 10, 11 and 12, and would replace the riveting extensions. Alternatively, as shown in FIG. 22, a support bar 98 could be provided with struck-out tongues 100 formed by striking out diagonal pieces of metal, instead of length wise portions 96 as shown in FIG. 21. In this way, the tongues 100 can be arranged somewhat closer together along the bar 98.

Figure 19:
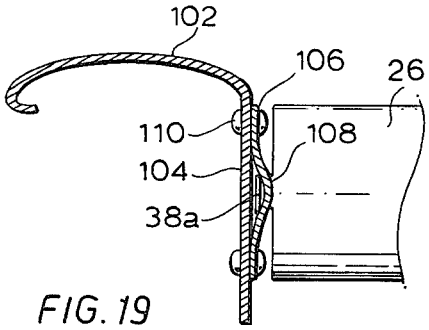
FIGS. 19 and 20 show further alternate forms of frame stock and alternate forms of blade support bars.
Figure 20:
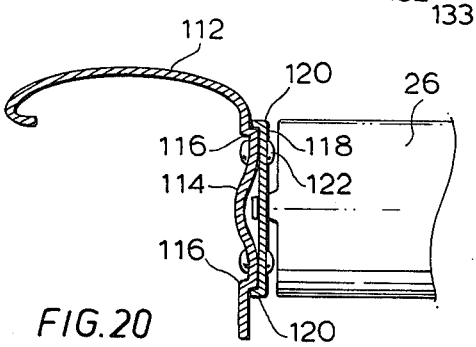

Further modifications may be made both with respect to the side frame and the support bars as shown in FIGS. 19 and 20. For example, shown in FIG. 19 the side frame may be made with a facing portion 102 similar to the facing portion 14 of FIG. 1. However, the side wall 104 may be made without any channel or recess at all, and simply being a flat linear member. In this case, the support bars 106 might be formed with a continuous lengthwise groove 108, for receiving the turned over portions 38*a* of the riveting extensions of the blades 26. The support bars 106 would be fastened in position by any suitable fastening means such as rivets 110, or screws or spot welding or the like.

As shown in FIG. 20, a modified form of frame may be constructed having a facing member 112, and a side wall 114 defining a continuous lengthwise recess or groove, and having upper and lower shoulders 116 extending lengthwise parallel with the groove 114.

A modified form of support bar 118 may be provided having upper and lower angled portions 120 fitting around the shoulders 116. Again, the support bars 118 would be fastened in position by any suitable fastening means such as rivets 122, or screws, spot welding or the like.

Figure 3:
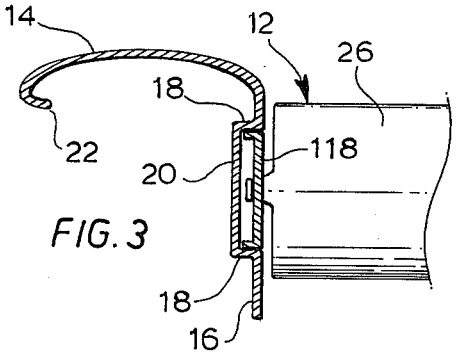
FIG. 3 is a section corresponding to FIG. 2 showing an alternate embodiment.

Such a modified support bar 118, of rectangular channel shape in section can also be used with the frame side wall 16 as shown in FIG. 3. The support bar 118 will of course be made so as to fit within the channel 17 as shown. The channel shape of bar 118 will provide the necessary clearance for the riveting extensions 38.

It will, therefore, be understood that the invention broadly comprises an air director blade assembly for an air grille, said assembly having a plurality of air director blades arranged transversely of said frame extending from side to side thereof parallel with one another, and there being a pair of blade supporting bar members supporting and locating the opposite ends of said blades, the blade supporting bars being adapted for mounting on the opposite side members of a framework, whereby the blades and blade supporting bars may be assembled independently of the frame and placed in position in a frame to complete the air grille.

The invention further comprises, as a separate component, a frame specifically adapted to receive a preformed blade assembly, and novel blades for use in such assembly.

The invention also envisages a composite air grill using such components, and also a corner locking member for locking the frame components together in a rectangular form.

Figure 23:
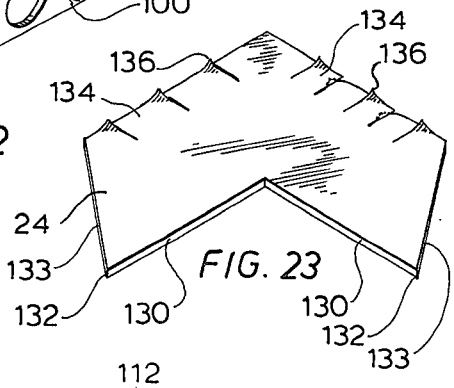

The locking plates 24 are shown in detail in FIG. 23.

Plates 24 have inner edges 130 extended to form angled pointed corners 132. The end edges 133 are angled at 45° so that the outer edges 134 are the same length as the inner edges 130.

Teeth 136 are formed on the outer edges 134 by shearing the metal at intervals and bending generally triangular portions upwardly or downwardly, (or in both directions).

The use of inner and outer edges of the same length permits the plates 24 to be manually inserted in the ends of the frame portions and pressed home by hand.

The term air grille is used through in a general sense to indicate any opening through which air or gas passes in a directed manner. In particular, it does not exclude combinations of an air damper, with such a grille, which is sometimes known as an "air register".

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A frame member for use in the construction of a frame for an air grille, said frame member comprising;
   a facing flange adapted to provide a border for said air grille, and having inner and outer edges;
   a frame wall extending along said inner edge at an angle relative to said flange for supporting said air grille;
   recessed channel means formed along said frame wall;
   an inturned portion on said outer edge of said facing flange and defining a groove therebetween;
   four rectangular L-shaped joining members, at the four corners of said frame, said joining members fitting in said groove, and,
   tooth means on said joining members engaging at least one of said flange and inturned portion.

2. A rotatable air director blade for use in an air grille, said blade comprising,
   an air director blade portion of predetermined width and length of hollow construction defined by two opposed spaced apart side walls forming in section, a generally flattened elliptical shape, and having a longitudinal axis of rotation, and,
   flat tongue-like extension members extending in pairs integrally from each end of each of said walls of said blade portion, and of reduced width in relation thereto, located along opposite sides of said longitudinal axis of rotation in parallel spaced apart relation;
   said extension members defining four longitudinal side edges forming bearing surfaces on which said blade may be rotated.

3. A rotatable air director blade as claimed in claim 2 including shoulders formed on each of said walls adjacent said tongue members.

4. A rotatable air director blade as claimed in claim 2 wherein said blade is made of a single piece of sheet metal folded lengthwise to form a double-walled hollow structure, and wherein said tongue-like members are formed integrally from said single piece of sheet metal.

5. A rotatable air director blade as claimed in claim 3 wherein said longitudinal axis is offset towards one edge of said blade.

6. An air grille assembly comprising;
   frame members of four-sided rectangular shape;
   air director blades arranged in a parallel formation extending between two opposite sides of said rectangular frame means, said blades being of predetermined width and length and having a longitudinal axis of rotation;
   longitudinal recess means in each end of said blade located along said axis of rotation;
   blade supporting bar means at each end of each said blade, extending between the ends of said blades;
   retaining pin means secured to said bar means and fitting in said recess means rotatably fastening said blades between said bar means;
   frictional formations on said pin means for securing said blades in a desired position, and,
   means supporting said blade supporting bar means in said frame means.

7. An air grille as claimed in claim 6 including channel means formed in said frame on at least said two opposite sides, said channel means being shaped and adapted to receive said blade supporting bar means.

8. An air grille as claimed in claim 7 including openings formed at spaced intervals along said blade supporting means, and said pin means extending through said openings into said recesses, and having heads on their free ends.

9. An air grille as claimed in claim 6 wherein said retaining pins and a respective said bar means are formed as a single integral structure, with said pin means extending perpendicularly from said bar means, and said frictional formations being formed integrally on said pin means.

10. An air grille assembly comprising;
   frame means of four-sided rectangular shape;
   air director blades arranged in a parallel formation extending between two opposite sides of said rectangular frame means, said blades being of predetermined width and length and having a longitudinal axis of rotation;
   longitudinal recess means in each end of said blade located along said axis of rotation;
   blade supporting bar means at each end of each said blades, extending between the ends of said blades;
   integral tongue means struck out from said bar means and extending into said recesses thereby retaining said blades on said bar means, and,
   means supporting said blade supporting bar means in said frame means.

11. An air grille assembly comprising;
   frame means of four-sided rectangular shape;
   air director blades of double walled hollow construction arranged in a parallel formation extending between two opposite sides of said rectangular frame means, said blades being of predetermined width and length and having a longitudinal axis of rotation;
   blade supporting bar means at each end of each said blade, extending between the ends of said blades and having openings therein, said bar means being mounted on opposite sides of said frame means;
   flat tongue members formed integrally on the ends of both said walls of said blades in spaced part relation on opposite sides of said axis thereof and passing through respective said openings in said blade supporting bar means, and end portions of said members being bent outwardly from one another around said openings to retain said blades on said blade supporting bar means.

12. An air grille assembly as claimed in claim 11 wherein said frame includes a facing flange adapted to provide a border for said air grille and having inner and outer edges,
   means defining a groove adjacent said outer edge,
   four rectangular L-shaped joining members at the four corners of said frame, fitting partially within said groove,
   tooth means on said joining members engaging said groove.

13. An air grille as claimed in claim 11 including channel means formed in said frame on at least said two opposite sides, said channel means being shaped and adapted to receive said blade supporting bar means.

14. An air grille as claimed in claim 11 including depressions formed in said blade supporting bar means around said openings.

15. An air grille as claimed in claim 11 including shoulders formed on said blades adjacent said extensions.

16. An air grille as claimed in claim 11 wherein said bar means is of shallow channel-shape in cross-section, with channel side walls extending away from said blades.

17. An air grille as claimed in claim 11 including further channel means formed in said frame parallel to and spaced from said first mentioned channel means, and further air director blades, and blade supportint bar means therefore, being received in said further channel means to provide a double layer of said blades for said grille.

18. An air grille assembly comprising;

frame means of four-sided rectangular shape;

air director blades arranged in a parallel formation extending between two opposite sides of said rectangular frame means, said blades being of predetermined width and length and having a longitudinal axis of rotation;

a longitudinal fold formation along each said blade;

blade supporting bar means at each end of each said blade, extending between the ends of said blades and having openings therein, said bar means being mounted on opposite sides of said frame means;

integral bearing members formed integrally on the ends of said blades and comprising endwise extensions of said fold formation and passing through respective said openings in said blade supporting bar means, and end portions of said bearing members being bent outwardly around said openings to retain said blades on said blade supporting bar means.

19. An air grille assembly as claimed in claim 18 wherein said blade has two blade walls forming an angle with one another, said fold formation being located at the junction between said blade walls.

20. An air grille assembly as claimed in claim 18 wherein said fold formation is of generally cylindrical shape, located along one edge of said blade, said bearing member being of generally semi-cylindrical shape corresponding thereto.

* * * * *